US007695772B2

(12) United States Patent
Räsänen et al.

(10) Patent No.: US 7,695,772 B2
(45) Date of Patent: Apr. 13, 2010

(54) DIGITAL PRINTING OF POLYMER-COATED PAPER OR BOARD

(75) Inventors: Jari Räsänen, Imatra (FI); Johanna Lahti, Pori (FI); Antti Savolainen, Kangasala (FI); Jurkka Kuusipalo, Tampere (FI)

(73) Assignee: Stora Enso Oyj, Helsinki (FI)

( * ) Notice: Subject to any disclaimer, the term of this patent is extended or adjusted under 35 U.S.C. 154(b) by 656 days.

(21) Appl. No.: 10/592,640

(22) PCT Filed: Jun. 16, 2005

(86) PCT No.: PCT/FI2005/000282

§ 371 (c)(1),
(2), (4) Date: Sep. 13, 2006

(87) PCT Pub. No.: WO2005/124469

PCT Pub. Date: Dec. 29, 2005

(65) Prior Publication Data

US 2007/0178285 A1 Aug. 2, 2007

(30) Foreign Application Priority Data

Jun. 17, 2004 (FI) ..... 20040840

(51) Int. Cl.
*B05D 1/06* (2006.01)

(52) U.S. Cl. ..... 427/466; 427/469; 427/555

(58) Field of Classification Search ..... 427/466, 427/469

See application file for complete search history.

(56) References Cited

U.S. PATENT DOCUMENTS

| | | | | |
|---|---|---|---|---|
| 3,481,775 | A * | 12/1969 | Albertson | 428/486 |
| 3,729,332 | A * | 4/1973 | Grubb et al. | 428/486 |
| 5,614,345 | A * | 3/1997 | Gumbiowski et al. | 430/104 |
| 6,051,305 | A | 4/2000 | Hsu | |
| 2001/0028944 | A1 | 10/2001 | Fujimoto | |
| 2003/0148048 | A1 * | 8/2003 | Yoshizawa et al. | 428/32.34 |

FOREIGN PATENT DOCUMENTS

| | | | |
|---|---|---|---|
| EP | 0 466 503 | A | 1/1992 |
| EP | 0 629 930 | A2 | 12/1994 |
| EP | 0 729 074 | A1 | 8/1996 |
| FI | 113807 | B | 6/2003 |
| WO | WO-03/054634 | A | 7/2003 |

* cited by examiner

*Primary Examiner*—Frederick J Parker
(74) *Attorney, Agent, or Firm*—Birch, Stewart, Kolasch & Birch, LLP

(57) ABSTRACT

The invention relates to a method for digitally printing a polymer-coated paper or board (1), to a paper or board suitable for the method and to the production of a product package equipped with digital prints. During digital printing, printing ink particles are applied in an electric field to the printing surface formed of a polymer coating at locations corresponding to the print, and the printing ink is adhered to the printing surface by fusion with the aid of infrared radiation. In accordance with the invention, the paper or board (2) to be printed is equipped with an inner coating layer (3) containing electrically chargeable ethene acrylate copolymer, such as ethene methyl acrylate copolymer (EMA), and with a polyolefin-based outer shield layer (4) on top of this, which contains e.g. low-density polyethene (LDPE) and provides mechanical strength, forming the printing surface receiving the printing ink.

20 Claims, 1 Drawing Sheet

DIGITAL PRINTING OF POLYMER-COATED PAPER OR BOARD

FIELD OF THE INVENTION

The invention relates to a method for digital printing of polymer-coated paper or board, in which printing ink particles are applied in an electric field to a printing surface formed of a polymer coating, corresponding to printing, and the printing ink is adhered to the printing surface by fusion with the aid of infrared radiation in order to form a print. The invention also comprises a paper or board suitable for the method and a method for producing a product package provided with digital prints.

BACKGROUND OF THE INVENTION

Digital printing as a technique is known and widely used in colour printing, copying machines and printers, among others. EP Patent Application 629930 describes digital printing techniques producing multi-colour print on one or both sides of a moving paper web. The different printing colour shades are produced at consecutive synchronised printing stations placed along the web path. Each station comprises a rotating drum with a charger disposed at its periphery for generating a regular electric charge on the surface of the drum. At the drum periphery, the charger is followed by a print head, such as a laser scanner, which generates a latent image on the surface of the drum by selective modification of the charge of the drum surface, the latent image being subsequently developed at a development station, where printing colour particles charged with opposite signs are brought to locations on the drum surface corresponding to the image. After this, the drum surface is contacted with a paper web guided to pass by laterally in order to transfer image-forming printing ink particles to the web surface. To this end, a corona transfer device has been mounted at the tangential point between the drum and the web, at the opposite side of the web, the electric current led over the corona transfer device generating an electric field, which attracts electrically charged printing ink particles from the drum surface to the paper web surface. In the immediate vicinity of the corona transfer device, an alternating current corona device has been mounted to eliminate the charges of the web, allowing the web to deviate from the drum surface. The drum surface is then precharged with the corona device and cleaned from any remaining printing ink particles, after which the surface is ready for a new printing cycle, which may equally well be identical with the preceding cycle as different from this.

As described above, monochrome print can be produced on one side of a paper at one single printing station using black printing ink. In multicolour printing, the different printing inks are applied to the paper at several consecutive printing stations, which operate with different colours, adding the colours one by one to the print generated on the moving web. Double-sided printing of a paper can further be achieved by disposing printing stations as described above on both sides of a moving paper web.

After a print composed of one or more printing inks has been applied to the paper as described above, the print is adhered at a fixing station disposed on the web path. Adhesion takes place by means of infrared radiators, which heat the web surface, resulting in fusion of the polymer printing ink particles to the paper. Eventually, the finished printed web can be either divided into sheets, which are piled or stitched whenever necessary, or it can be rewound.

On principle, similar technique is applied in copying machines and printers, in which the printing substrate consists of individual sheets instead of a continuous web. Besides paper sheets, plastic films are suitable as a substrate in copying machines.

WO patent specification 03/054634 discloses digitally printed papers and boards, whose printing surface consists of a polymer coating containing electrically chargeable ethene acrylate copolymer. The specification examined by means of coronation the chargeability of copolymer of ethene methyl acrylate (EMA), polyethylene terephtalate (PET) and low-density polyethene (LDPE) and also conducted a more comprehensive comparative test series regarding the printing quality obtained in digital printing with boards coated with different polymers. 20% EMA proved the best coating polymer, i.e. EMA in which methyl acrylate monomer accounted for 20 molar %. The results of this specification indicated a markedly lower digital printing quality of low-density polyethene (LDPE) and high-density polyethene (HDPE), which are polyolefins commonly used as the coating of packaging boards.

However, copolymers of ethene acrylate are characterised by being soft and of having a low fusion point, e.g. the fusion point of 20% EMA mentioned above is approx. 80-90° C. Due to their softness, they are exposed to friction and wear when used as the uppermost coating layer on packaging board. Their low fusion point makes them readily heat sealable as such, yet excessively fusionable during sealing, and hence more difficult to control than e.g. the most commonly used heat-sealing polymer LDPE. Due to their stickiness, they also cause problems in extrusion, e.g. by their tendency to adhere to the cooling roll, requiring thus necessarily the adoption of low running speeds.

WO patent specification 03/054634 mentions the stickiness of EMA, which increases as the proportion of methyl acrylate monomer in the polymer increases. The specification has reached an approximate proportion of 15% of methyl acrylate monomer as a compromise between non-stickiness of the coating and high printing quality. The specification also states that it is possible to apply a protective varnish onto the digitally printed surface after fusion of the printing ink, however, this would involve a further work step in the printing process.

SUMMARY OF THE INVENTION

The invention has the purpose of resolving the mechanical problems mentioned above relating to digitally printed polymer-coated paper or board so as to achieve a wear-resistant printing surface without separate protective operations after the printing. The digital printing method of the invention is characterised by the printing being performed on paper or board provided with an electrically chargeable inner coating layer containing ethene acrylate copolymer and with an upper polyolefin-based protective layer giving mechanical strength and forming eventually the printing surface receiving the printing ink.

The invention is based on the surprising observation that high digital printability achieved with ethene acrylate copolymer does not disappear or even deteriorate notably when a layer containing this is coated with a thin polyolefin layer forming a shield layer acting simultaneously as the printing surface for receiving the printing ink. The outcome is unexpected, considering that previous research has found LDPE and HDPE to have poor digital printing quality.

The invention achieves obvious advantages based on the profitable mechanical properties of polyolefins, such as LDPE or HDPE. Given their fusion temperatures higher than those of ethene acrylate copolymers, they are easier to extrude and coextrude and have higher wear resistance. They do not markedly affect printing ink adhesion under IR radiation; they are fusioned with the polymer component melting under the radiation of the printing ink, perhaps partly also melting themselves in this conjunction.

Among electrically chargeable ethene acrylate copolymers usable in the invention, we may cite especially ethene methyl acrylate copolymer (EMA), in which the proportion of methyl acrylate monomer is 9-20 molar %, preferably about 20 molar %. Other potential polymers comprise ethene ethyl acrylate copolymer (EEA), which closely resembles EMA, and ethene butyl acrylate copolymer (EBA). A polymer layer containing these polymers has a recommended weight in the range 7-20 g/m$^2$.

These polymers can be used as such in the chargeable layer, or they can be doped in another polymer, such as a polyolefin contained in an upper shield layer.

Polymers suitable for the outermost coating layer acting as a mechanical shield and a printing surface comprise, besides the low-density polyethene (LDPE) and high-density polyethene (HDPE) mentioned above, their mixtures, or e.g. mixtures in which LDPE is doped in another polymer, such as e.g. polypropene (PP). LDPE and its mixtures have the special advantage of easy heat sealability with commonly used sealers. To ensure good digital printability of the coating, the shield layer should be thin, preferably with a weight in the range 2-10 g/m$^2$ and more advantageously in the range 5-7 g/m$^2$.

The method of the invention for producing a product package provided with prints is characterised by a packaging paper or board provided with polymer coating layers as described above being digitally printed in accordance with the invention, and then creased and heat-sealed to form a package.

The polymer-coated, digitally printable paper or board included in the scope of the invention is characterised by being provided with an electrically chargeable inner coating layer containing ethene acrylate copolymer and with an outer polyolefin-based shield layer adhered directly to this without a binder in order to provide mechanical strength, the shield layer forming the printing surface receiving the printing ink.

When the polymer-coated paper or board of the invention is used e.g. in food packages, it can be equipped with one or more water vapour and/or oxygen barrier layers, whose typical polymers comprise i.a. ethyl vinyl alcohol copolymer (EVOH) and polyamide (PA). The barrier layer can be disposed between the paper or board base and the chargeable acrylate copolymer layer, or optionally on the opposite side relative to the printing surface of the paper or board. In sealable packages, the paper or board comprises preferably an outermost, heat-sealable polyolefin layer on both sides. The polymer layers forming the coating on top of one another can be produced on the paper or board substrate by coextrusion in a manner known per se.

BRIEF DESCRIPTION OF THE DRAWINGS

The invention is explained in greater detail below by means of examples and with reference to the accompanying drawing, in which.

DETAILED DESCRIPTION OF THE INVENTION

Figure 1:
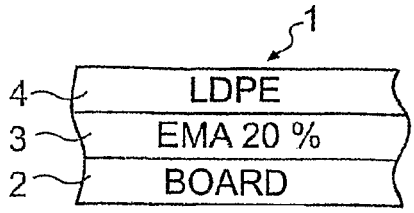
FIG. 1 shows a board of the invention having an EMA layer on the one side and an LDPE shield layer on top of this.

FIG. 1 shows a polymer-coated digitally printable board 1 of the invention, in which one side of the fibre substrate 2 has been coated by coextrusion with a polymer coating consisting of an inner electrically chargeable EMA layer 3 and a thinner outer LDPE shield layer 4. The fibre substrate 2 may consist e.g. of a triple-layer board formed of an intermediate layer of chemithermo-mechanical pulp (CTMP) and outer layers of bleached sulphate, having a weight in the range 130-600 g/m$^2$, preferably 170-300 g/m$^2$. The EMA contained in the chargeable layer 3 has been formed by copolymerising ethene and methyl acrylate monomers, with the latter accounting for 20 molar % in the monomer composition. This EMA quality has a particularly advantageous digital printing quality. The EMA layer 3 may have a weight in the range 7-20 g/m$^2$. The outer LDPE layer 4 may have a weight in the range 2-10 g/m$^2$, preferably 5-7 g/m$^2$. The LDPE layer 4 acts as the mechanically durable printing surface of the board, which receives the printing ink particles and to which the printing ink is adhered by fusion with the aid of IR radiation. The LDPE layer 4 thus acts as a shield layer for the underlying softer EMA layer 3, while the electrically chargeable EMA markedly improves the printing quality compared to the quality attained with an LDPE coating layer alone. LDPE in the outer layer 4 has the additional advantage of being heat sealable and thus apt for various package applications.

Figure 2:
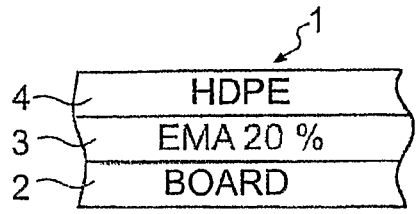
FIG. 2 shows a board of the invention having an EMA layer on the one side and a HDPE shield layer on top of this.

The embodiment of the invention illustrated in FIG. 2 differs from the one in FIG. 1 only in that the polymer of the outer shield layer 4 is HDPE instead of LDPE. In visual assessments, the polymer layer combination 3, 4 both of FIGS. 1 and 2 has achieved a high digital printing quality. Due to its higher fusion point, HDPE is less readily heat sealable than LDPE, however, applied as a very thin layer 4 in accordance with the invention, it may melt during hot-air heat sealing so that tight sealing is provided by means of the subjacent readily melting EMA layer.

Figure 3:
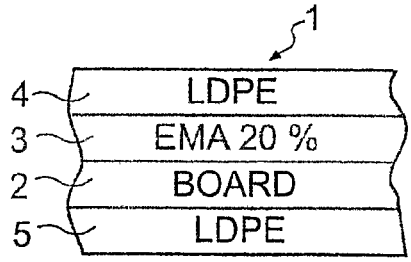
FIG. 3 shows a board corresponding to the one illustrated in FIG. 1, except that also the opposite side of the board is coated with an LDPE layer.

The embodiment of the invention of FIG. 3 differs from the one in FIG. 1 in that the opposite side of the fibre substrate 2 is equipped with an LDPE heat-sealing layer having a possible weight in the range 10-40 g/m$^2$. Such a packaging board coated on both sides is particularly suitable for casing and container packages closed by heat sealing, whose outer surface is provided with digital prints.

Figure 4:
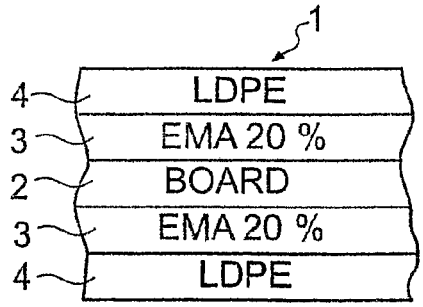
FIG. 4 shows a board coated on both sides with an EMA layer and an LDPE shield layer.

The embodiment of the invention illustrated in FIG. 4 comprises the EMA and LDPE layers 3, 4 on top of each other as described above, disposed symmetrically on both sides of the fibre substrate 2. Such a coated board can be digitally printed on both sides equally well. If the board is heat sealed to form packages, any one of its two sides may form the digitally printed outer surface of the package.

Figure 5:
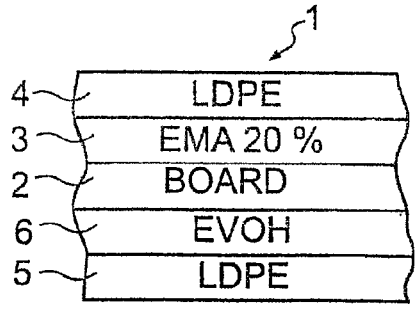
FIGS. 5 and 6 show boards corresponding to the one illustrated in FIG. 3, but with an EVOH oxygen barrier layer added.

The embodiment of the invention illustrated in FIG. 5 differs from the one illustrated in FIG. 3 in that an EVOH oxygen barrier layer 6 has been inserted between the fibre substrate 2 and the LDPE heat-sealing layer 5 on the side of the fibre substrate 2 opposite to the EMA layer 3. If necessary, a binder layer can be additionally provided between the EVOH and LDPE layers 6,5. Such a coated board is suitable for oxygen-proof packages closed by heat sealing, such as e.g. food packages, in which the outer surface of the package is digitally printed, with the oxygen barrier 6 remaining within the fibre substrate 2 of the package. The EVOH layer 6, which prevents both oxygen and water vapour penetration, may have a weight e.g. in the range 5-10 g/m$^2$. Instead of EVOH, the oxygen barrier may also consist e.g. of polyamide. EVOH and polyamide are also jointly usable as layers on top of each other, thus mutually complementing the barrier properties of one another.

Figure 6:
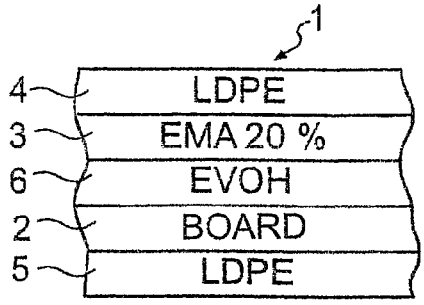
Figure 7:
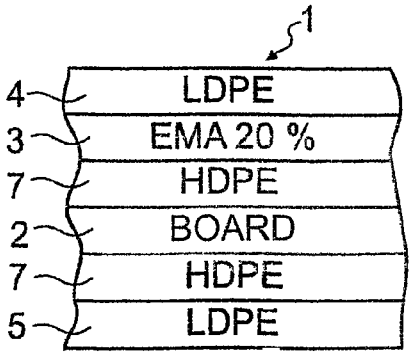
FIG. 7 shows a board corresponding to the one illustrated in FIG. 3, but with HDPE water vapour barrier layers added on both sides.

The embodiment of the invention illustrated in FIG. 6 differs from the one shown in FIG. 5 in that the EVOH oxygen barrier layer 6 is disposed between the fibre substrate 2 and the chargeable EMA layer 3. In FIG. 7, the fibre substrate 2 has also been provided with HDPE layers 7 acting as water vapour barriers on both sides, these layers having e.g. a weight in the range 10-20 g/m$^2$, preferably with the HDPE layers 7 substantially equally thick. The latter embodiment is intended especially for packages provided with digital prints, in which it is desirable to protect the packaged product and/or fibre substrate 2 against both external moisture and any moisture caused by the packaged product itself.

EXAMPLE 1

A series of tests was conducted, in which a cup board with a weight of 170 g/m$^2$ was digitally printed and which was coated on one side with a two-layered polymer coating, the weight of the inner coating layer being 15 g/m$^2$ and that of the outer layer 5 g/m$^2$. A total of 14 boards coated in different ways and subsequently coronated (samples 1-14) were multicolour printed (yellow, blue, red, black) following the technique disclosed by EP patent specification 629930 at a path speed of 7.35 m/min, and a six-member evaluation board evaluated the printing quality visually by ranking the printed samples into order of superiority, in which the best sample was given the value 1 and the poorest sample the value 14. The means and deviations have been calculated on these values. The tests also comprised measurement of the mottling values of green and red prints and of the abrasion resistance (%) of blue (cyan) and red (magenta). The results are given in table 1.

Visual evaluation has been considered the chief criterion with respect to high digital printing quality. However, it has the drawback of subjective assessments, which appears as value deviation among the members of the board. Nevertheless, the distinctly best results of the test series were obtained for samples 7 and 8, in which the EMA 20 layer (EMA in which methyl acrylate monomer accounts for 20 molar %) was covered with a thin LDPE or HDPE layer acting as the printing surface.

EXAMPLE 2

A test series was conducted comprising digital printing of a cup board having a weight of 170 g/m$^2$ and coated on one side with a two-layered polymer coating, whose inner coating layer had a weight of 15 g/m$^2$ and outer layer a weight of 5 g/m$^2$. A total of five boards coated in different ways and subsequently coronated (samples 1-5) were multi-colour printed (yellow, blue, red, black) following the technique of EP patent specification 629930 at a path speed of 7.35 m/min. The inner coating layer of samples 3-5 was a polymer mixture containing 5% (sample 3), 15% (sample 4) or 25% (sample 5) of the polymer used in example 1, EMA 20, i.e. EMA in which the methyl acrylate monomer accounted for 20 molar-%, with the remainder consisting of LDPE. A six-member evaluation board made a visual assessment of the printing quality by placing the printed samples in order of superiority, in which the best sample was given the value 1 and the poorest sample the value 5. The means of these values were calculated. The results are shown in table 2.

The by far best result of the test series was obtained with sample 2, in which the material of the innermost layer was pure EMA 20. Mixtures of EMA 20 and LDPE (samples 3-5) also yielded a better result than pure LDPE (sample 1).

TABLE 1

| | | Sample | | | | | | | | | | | | | |
|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 |
| Polymer layers | Inner | LDPE | EMA20 | EMA9 | HDPE | PET | EMA20 | EMA20 | EMA20 | SUR-LYN | SUR-LYN | SUR-LYN | EMA9 | EMA9 | EMA9 |
| | Outer | LDPE | EMA20 | LDPE | HDPE | PET | PET | LDPE | HDPE | LDPE | SUR-LYN | PET | EMA9 | PET | HDPE |
| Rating Evaluator | | | | | | | | | | | | | | | |
| 1 | | 3 | 11 | 6 | 4 | 5 | 14 | 2 | 1 | 8 | 12 | 9 | 13 | 7 | 10 |
| 2 | | 5 | 12 | 3 | 4 | 6 | 14 | 2 | 1 | 7 | 10 | 13 | 9 | 8 | 11 |
| 3 | | 3 | 10 | 5 | 4 | 8 | 14 | 1 | 2 | 6 | 7 | 13 | 11 | 12 | 9 |
| 4 | | 6 | 8 | 4 | 2 | 5 | 14 | 3 | 1 | 10 | 11 | 13 | 9 | 12 | 7 |
| 5 | | 4 | 13 | 3 | 5 | 8 | 14 | 2 | 1 | 7 | 10 | 11 | 12 | 9 | 6 |
| 6 | | 3 | 10 | 7 | 4 | 6 | 14 | 1 | 2 | 5 | 11 | 9 | 13 | 12 | 8 |
| Mean | | 4 | 10.7 | 4.7 | 3.8 | 6.3 | 14 | 1.8 | 1.3 | 7.2 | 10.2 | 11.3 | 11.2 | 10 | 8.5 |
| Deviation | | 1.3 | 1.8 | 1.6 | 1.0 | 1.4 | 0 | 0.8 | 0.5 | 1.7 | 1.9 | 2.2 | 2.3 | 2.5 | 1.9 |
| Mottling | | | | | | | | | | | | | | | |
| Green (cyan + yellow) | Mean | 7.16 | 5.10 | 5.72 | 5.67 | 6.21 | 5.23 | 5.20 | 5.51 | 5.93 | 8.25 | 7.86 | 6.29 | 5.49 | 6.12 |
| | Deviation | 0.34 | 0.26 | 0.61 | 0.55 | 0.11 | 0.24 | 0.40 | 0.31 | 0.52 | 0.77 | 0.63 | 0.38 | 0.30 | 0.46 |
| Red (Magenta + yellow) | Mean | 3.12 | 3.08 | 3.37 | 2.10 | 3.21 | 3.51 | 3.44 | 3.26 | 3.81 | 5.10 | 3.01 | 3.38 | 4.27 | 5.91 |
| | Deviation | 0.21 | 0.27 | 0.47 | 0.17 | 0.39 | 0.42 | 0.52 | 0.50 | 0.29 | 1.01 | 0.10 | 0.31 | 0.65 | 0.96 |
| Abrasional resistance % | Cyan | 1.9 | 2.0 | 0.7 | 1.6 | 2.9 | 1.1 | 1.8 | 1.0 | 2.6 | 0.8 | 2.0 | 5.0 | 1.5 | 2.0 |
| | Magenta | 6.0 | 12.4 | 7.4 | 6.6 | 7.2 | 7.5 | 11.1 | 2.8 | 6.2 | 6.0 | 6.1 | 11.3 | 8.3 | 6.0 |

TABLE 2

| | | Sample no. | | | | |
|---|---|---|---|---|---|---|
| | | 1 | 2 | 3 | 4 | 5 |
| Polymer layer | Inner | LDPE | EMA 20 | 5% EMA 20 | 15% EMA 20 | 25% EMA 20 |
| | Outer | LDPE | LDPE | LDPE | LDPE | LDPE |
| Rating Evaluator | | | | | | |
| 1 | | 5 | 1 | 2 | 4 | 3 |
| 2 | | 4 | 1 | 2 | 5 | 3 |
| 3 | | 5 | 1 | 2 | 3 | 4 |
| 4 | | 5 | 1 | 3 | 2 | 4 |
| 5 | | 5 | 2 | 1 | 4 | 3 |
| 6 | | 5 | 1 | 2 | 3 | 4 |
| Mean | | 4.8 | 1.2 | 2 | 3.5 | 3.5 |

The invention claimed is:

1. A method for digitally printing a polymer-coated paper or board, in which printing ink particles are applied by an electric field to a printing surface formed of a polymer coating, corresponding to digitally printing, and the printing ink is adhered to the printing surface by fusion with the aid of infrared radiation in order to form a print, characterised in that the digital printing is performed on said paper or board provided with an inner coating layer containing electrically chargeable ethene acrylate copolymer and an outer polyolefin-based shield layer which provides mechanical strength disposed on top of this inner coating layer forming the printing surface receiving printing ink.

2. A method as defined in claim 1, comprising a further step of using infrared radiation for melting the shield layer with a view to adhering the printing ink to the printing surface.

3. A method as defined in claim 2, characterised in that polymer-based printing ink particles are used, which are melted by infrared radiation so as to adhere to the printing surface.

4. A method as defined in claim 1, characterised in that the inner electrically chargeable coating layer of the paper or board contains ethene methyl acrylate copolymer (EMA), in which methyl acrylate monomer accounts for approximately 20 molar %.

5. A method as defined in claim 1, characterised in that the electrically chargeable inner coating layer has a weight in the range 7-20 g/m$^2$.

6. A method as defined in claim 1, characterised in that the shield layer contains low-density polyethene (LDPE), high-density polyethene (HDPE) or a mixture of these.

7. A method as defined in claim 1, characterised in that the shield layer is heat sealable.

8. A method as defined in claim 1, characterised in that the shield layer has a weight in the range 2-10 g/m$^2$, preferably 5-7 g/m$^2$.

9. A method for producing a product package equipped with prints, characterised in that a polymer-coated packaging paper or board is digitally printed as in claim 1 and is subsequently creased and heat-sealed to form a package.

10. A method for digitally printing a polymer-coated paper or board in which printing ink particles are applied by an electric field to a printing surface formed of a polymer coating, corresponding to digitally printing, and the printing ink is adhered to the printing surface by fusion with the aid of infrared radiation in order to form a print, characterised in that the digital printing is performed on said paper or board provided with an inner coating layer containing electrically chargeable ethene acrylate copolymer and an outer polyolefin-based shield layer providing mechanical strength disposed on top of this inner coating layer forming the printing surface receiving printing ink, wherein said paper or board is subsequently creased and heat-sealed to form a package.

11. A method as defined in claim 10, comprising a further step of using infrared radiation for melting the shield layer with a view to adhering the printing ink to the printing surface.

12. A method as defined in claim 11, characterised in that polymer-based printing ink particles are used, which are melted by infrared radiation so as to adhere to the printing surface.

13. A method as defined in claim 10, characterised in that the inner electrically chargeable coating layer of the paper or board contains ethene methyl acrylate copolymer (EMA), in which methyl acrylate monomer accounts for approximately 20 molar %.

14. A method as defined in claim 10, characterised in that the electrically chargeable inner coating layer has a weight in the range 7-20 g/m$^2$.

15. A method as defined in claim 10, characterised in that the shield layer contains low-density polyethene (LDPE), high-density polyethene (HDPE) or a mixture of these.

16. A method as defined in claim 10, characterised in that the shield layer has a weight in the range 2-10 g/m$^2$, preferably 5-7 g/m$^2$.

17. A method for digitally printing a polymer-coated paper or board which comprises the steps of:

providing paper or board with an inner coating layer containing electrically chargeable ethene acrylate copolymer and a heat-sealable outer polyolefin-based shield layer which provides mechanical strength disposed on top of this inner coating layer forming the printing surface for receiving printing ink; and digitally printing by applying printing ink particles by an electric field to said printing surface, whereby the printing ink is adhered to the printing surface by fusion with the aid of infrared radiation in order to form a print.

18. The method as defined in claim 17, wherein said infrared radiation is used for melting said shield layer in order to adhere a printing ink comprising polymer-based printing ink particles to said printing surface, which polymer-based printing ink particles are melted by infrared radiation so as to adhere to the printing surface.

19. The method as defined in claim 17, wherein the inner electrically chargeable coating layer of the paper or board contains ethene methyl acrylate copolymer (EMA), in which methyl acrylate monomer accounts for approximately 20 molar %.

20. The method as defined in claim 17 wherein said polymer-coated paper or board is a product package equipped with prints, said method further comprising the steps of creasing and heat-sealing the polymer-coated packaging paper or board to form a package subsequent to digitally printing the polymer-coated packaging paper or board.

* * * * *